United States Patent [19]

Kellogg

[11] 4,050,386

[45] Sept. 27, 1977

[54] SHELVING APPARATUS

[76] Inventor: Harlan F. Kellogg, 1617 Sprucewood, Rockford, Ill. 61107

[21] Appl. No.: 701,072

[22] Filed: June 30, 1976

[51] Int. Cl.[2] ..... A47B 3/00

[52] U.S. Cl. ..... 108/111

[58] Field of Search ..... 108/53.5, 91, 101, 111; 211/189, 194

[56] References Cited

U.S. PATENT DOCUMENTS

| | | | |
|---|---|---|---|
| 3,141,423 | 7/1964 | Christensen | 108/111 |
| 3,316,862 | 5/1967 | Dismuke | 108/111 |
| 3,549,020 | 12/1970 | Von Bohr | 211/188 |
| 3,741,404 | 6/1973 | Jordain | 211/188 |
| 3,783,801 | 1/1974 | Engman | 108/60 |
| 3,831,533 | 8/1974 | Kellogg | 108/64 |
| 3,834,324 | 9/1974 | Lang | 108/111 X |

FOREIGN PATENT DOCUMENTS

| | | | |
|---|---|---|---|
| 1,096,727 | 12/1967 | United Kingdom | 108/111 |

*Primary Examiner*—James C. Mitchell

*Attorney, Agent, or Firm*—Morsbach & Pillote

[57] ABSTRACT

A knock-down shelving apparatus including a plurality of vertically spaced shelves and a plurality of uprights extending between each shelf and the next lower shelf. Each upright has a multi-sided core and panels adhesively secured to the outer side faces of the core with one end of the core spaced axially outwardly from one end of the panels to provide a multi-sided tongue at one end of the uprights adapted to extend through a similarly shaped opening in the shelf and with the other end of the core spaced axially inwardly of the other ends of the panels to provide a socket for relieving the tongue on an axially aligned upright after it has passed through an opening in the shelf. The shelves have depending flanges engageable with the uprights to enhance the stability of the shelving apparatus when assembled.

12 Claims, 4 Drawing Figures

SHELVING APPARATUS

BACKGROUND OF THE INVENTION

Free-standing shelving has heretofore been made in which a plurality of shelves are supported in vertically spaced relation by uprights disposed between each shelf and the next lower shelf. It is common practice in such free-standing shelving, for example as shown in U.S. Pat. Nos. 3,783,801 and 3,831,533, to use spindles which have a threaded male member at one end that extends through an opening in the shelf and into a threaded socket in an axially aligned spindle at the other side of the shelf so that the end faces of the spindles can be drawn into firm contact with opposite faces of the shelf by relatively turning the spindles. With such shelving systems, it is common practice to utilize spindles in the form of turnings having a generally circular cross-section so that the rotational position of the spindle, when tightened, is immaterial. Such screw arrangements for interconnecting spindles at opposite sides of a shelf, however, are not suitable for use with spindles of non-circular cross-section which must be oriented to a predetermined angular position to the edges of the shelf.

It has also been proposed, as shown in U.S. Pat. No. 3,549,020 to form a modular shelving apparatus in which the end panels at the ends of the shelves are formed with upper extensions of reduced cross-section that extend through openings in the ends of the shelves and into the lower end of the next adjacent end panel. However, such shelving apparatus having solid end panels are not suitable for those applications where open shelving is desired.

The various objects of the present invention are to provide a free-standing shelving apparatus of the type having uprights adjacent each corner of the shelves for maintaining the shelves in spaced relation in which the uprights have a multi-sided cross-section and a non-rotatable interfit with the shelves and with the adjacent uprights to orient the same in proper angular relation with respect to the edges of the shelf; which can be assembled without the use of tools or fasteners; which is strong and rigid when assembled; and which is economical to fabricate and easy to assemble.

These, together with other objects and advantages of the invention, will be more readily understood by reference to the following detailed description when taken in connection with the accompanying drawings wherein.

SUMMARY OF THE INVENTION

The free-standing shelving apparatus includes a plurality of shelves of polygonal configuration with uprights extending between each shelf and the next lower shelf adjacent the corners of the shelves. At least some of the shelves having openings adjacent the corners of the shelves at locations inwardly of the periphery of the shelves and the uprights have a multi-sided cross-sectional configuration with a multi-sided tongue on one end adapted to extend downwardly through the opening in the shelf and into a multi-sided socket at the end of an axially aligned upright to interconnect the shelves and uprights with the uprights oriented in proper relation to each other and to the edges of the shelf.

In the preferred embodiment of the invention, the uprights are formed with a solid multi-sided core having panels adhesively secured to the outer side faces of the core with one end of the core spaced axially outwardly from one end of the panels to provide a multi-sided tongue at one end of the uprights and with the other end of the core spaced axially inwardly from the other end of the uprights to provide a multi-sided socket for receiving the tongue on an axially aligned upright. The multi-sided uprights advantageously have an L-shaped cross-section to enhance the strength and rigidity of the shelving apparatus while minimizing overall weight and amount of material required. The shelves also advantageously have depending flanges engageable with the multi-sided uprights to aid in orienting the uprights and in laterally stabilizing the shelving apparatus when assembled.

Figure 2:
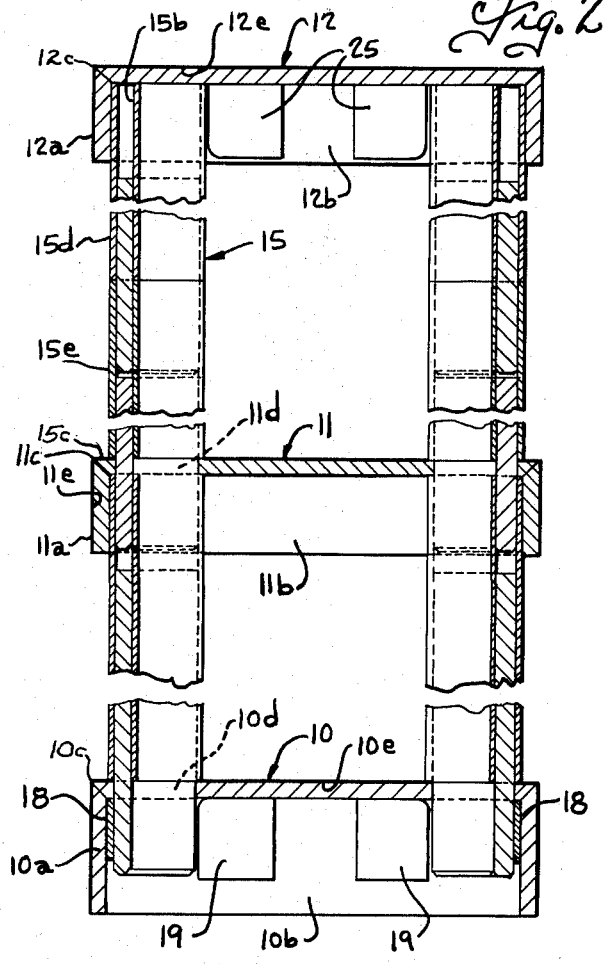
FIG. 2 is a vertical sectional view taken on the plane 2—2 of FIG. 1.

Referring now more specifically to the accompanying drawings, the shelving apparatus includes a base shelf 10, one or more intermediate shelves 11, an an upper shelf 12. The shelves are of polygonal configuration, and they are preferably of rectangular shape with each of the shelves 10–12 being of the same size as viewed in plan. For reasons pointed out hereinafter, the shelves 10–12 respectively have side and end flanges **10*a*, 10*b*; 11*a*, 11*b* and 12*a*, 12*b* which extend downwardly from the underside of the shelves. The shelves are preferably formed of material such as wood or wood composition board and, as best shown in FIG. 2, the depending flanges are preferably joined to the respective shelves by mitered joints designated 10*c*, 11*c* and 12*c*. The shelves can be finished in any desired manner as by paint, varnish or the like or may be covered by a suitable decorative plastic sheet shown as a dark line at 10*e*, 11*e* and 12*e* in FIG. 2**. Conveniently, the shelves and flanges are formed by miter-folding. More particularly, a panel of wood or composition board is covered with a sheet of flexible, decorative plastic such as polyvinyl chloride and sized to have a width equal to the combined width of the shelf and side flanges and a length equal to the combined length of the shelf and end flanges. The back side of the board is then routed or grooved with grooves of about 90° included angle along lines corresponding to the edges of the shelf and ends of the side and end flanges to a depth down to the flexible plastic covering. After removing the portions of the board at the four corners, the sides and ends of the board are folded and glued to form the shelf with a peripheral depending flange.

The intermediate and lower shelves 11 and 10 are formed with generally multi-sided openings **11*d* and 10*d*** respectively adjacent the corners of the shelves and spaced inwardly of the side and end flanges. In the rectangular shelves illustrated, four such openings are provided in each of the base and intermediate shelves adjacent each corner of the shelves.

The shelves are supported and spaced in parallel relation by sets of uprights 15, one for each corner of the shelf, which extend between the shelf and the next lower shelf. The uprights 15 of each set are multi-sided and are preferably formed with a generally L-shaped cross-section. As shown, the uprights 15 have a tongue **15*a* of L-shaped cross-section at one end and a socket 15*b* of L-shaped cross-section at the other end dimensioned to receive the tongue on an end-wise aligned upright. The openings 10***d* and 11*d* in the base and intermediate shelves are L-shaped configurations dimensioned to receive the tongues 15*a* and the legs of the openings extend from adjacent the corners of the shelves generally parallel to the side and end flanges on the shelves to anularly orient the uprights relative to the sides and ends of the shelves. The legs of the tongue 15*a* have a thickness less than the thickness of the legs of the upright to form a shoulder 15*c* at the juncture of the tongue with the upright and, as best shown in FIG. 2, the shoulder is adapted to abut the upper face of the shelf therebelow when the tongue is inserted through the opening 11*d* in the shelf. The intermediate and upper shelves 11 and 12 are arranged to rest on the upper ends of the respective set of uprights 15 with the side and end flanges on the shelves engaging the outer faces of the uprights. The tongue 15*a* on the set of uprights above the intermediate shelf extend through the openings 11*d* therein and into the sockets 15*b* at the upper ends of the set of uprights below the intermediate shelf. Pads 18 are provided on the inner face of the side and end flanges of the base shelf at locations to engage the tongues 15*a* on the lower set of uprights to laterally stabilize the same. Additional pads 19 can also be provided on the side and end flanges on the base shelf to engage the edges of the L-shaped tongues on the lower set of uprights.

Figure 4:
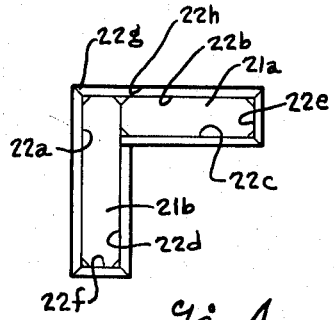
FIG. 4 is an end view of one of the uprights illustrating the same on a larger scale.
Figure 3:
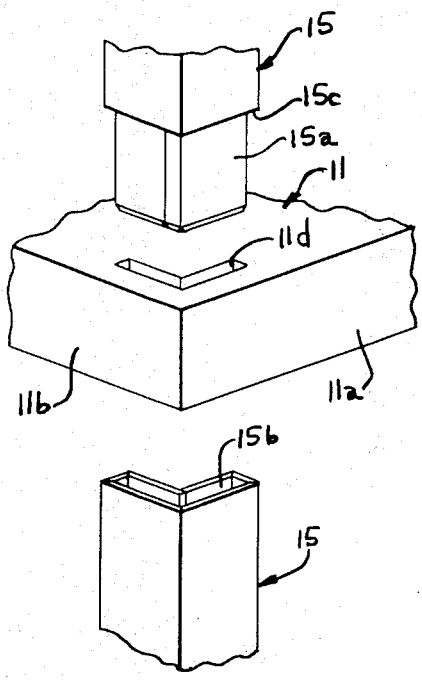
FIG. 3 is a fragmentary exploded perspective view illustrating assembly of the shelves and uprights.

The uprights are advantageously formed of a solid multi-sided core and thin panels formed of plywood composition board or the like adhesively secured to the outer faces of core with one end of the core being spaced outwardly from the panel members to provide a multi-sided tongue and with the other end of the core member being spaced inwardly from the other end of the panel members to provide a multi-sided socket. In the L-shaped uprights shown, the core includes members 21*a* and 21*b* adhesively joined together to form a generally L-shaped core and the panel members include outer panel members 22*a*, 22*b*, inner panel members 22*c*, 22*d* and edge panel members 22*e* and 22*f*. The several panel members on the uprights are advantageously joined along mitered corners 22*g*, and the outer faces of the panels covered with a sheet of decorative plastic or the like shown as a heavy line at 22*h* in FIG. 4. The several panels on the uprights 15 are conveniently formed by miter-folding in which a panel of wood or composition board is first covered with a sheet of thin flexible decorative plastic such as polyvinyl chloride and the panel then routed or grooved from the back side of the board to the flexible plastic along lines corresponding to the corner fold lines of the upright. The grooved board can then be folded around the core and adhesively bonded thereto.

The upper shelf 12 rests on the upper side of the upper set of uprights and the side and end flanges on the upper shelf engage the outer faces of these uprights. Pads 25 are conveniently provided on the inner faces of the side and end flanges on the upper shelf to engage the edges of the upper ends of the upright for stabilizing the same.

Figure 1:
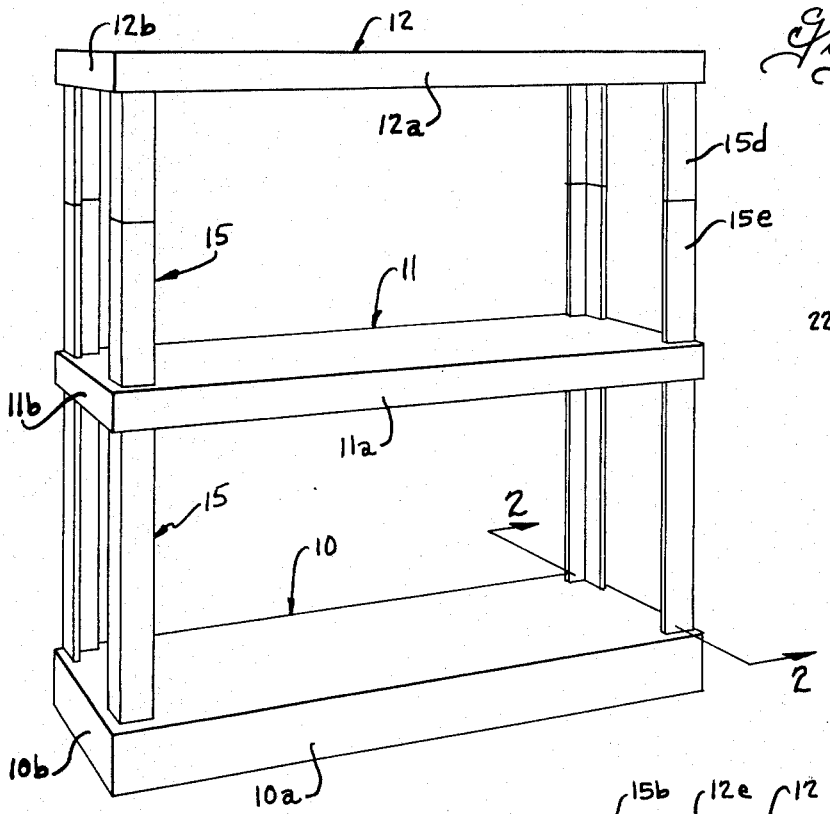
FIG. 1 is a perspective view of a shelf apparatus embodying the present invention.

The uprights 15 can be made of any desired length and, conveniently, several uprights designated 15*d* and 15*e* in FIGS. 1 and 2 can be telescopically joined together.

From the foregoing it will be seen that the shelf apparatus can be readily assembled without the use of tools or fasteners by merely inserting the tongues on the ends of one set of uprights into the openings 10*d* in the base shelf with the flange 15*c* on the upper edge resting on the upper shelf and with the pads 18 and 19 on the base shelf engaging the tongue on the uprights. The intermediate shelf is then positioned on the upper ends of the lower set of uprights and the upper set of uprights are then assembled by inserting the tongues 15*a* thereon through the openings in the intermediate shelf and into the sockets in the upper ends of the lower set of uprights. The flanges on the intermediate shelf engage the outer face of the lower set of uprights to stabilize the connection of the upper and lower sets of uprights with the intermediate shelf. The upper shelf is thereafter assembled on the upper ends of the upper uprights.

The L-shaped uprights provide a strong but light weight shelf support and, when assembled and engaged with the flanges on the shelves, provides a shelf assembly which is rigid and highly stable to lateral loading from either the sides or ends of the shelf assembly. The L-shaped tongues on the uprights when extended through the corresponding L-shaped opening in the shelves hold the uprights in proper angular position with respect to the shelf.

The embodiments of the invention in which an exclusive property or privilege is claimed are defined as follows:

1. In a free-standing shelving apparatus including a plurality of shelves of polygonal configuration disposed in vertically spaced relation and a plurality of uprights extending between each shelf and the next lower shelf, the improvement comprising said uprights each including a solid core having a multi-sided configuration and panel members adhesively joined to each of the side faces of the core, one end of the core being spaced axially outwardly from one end of the panel members to provide a multi-sided tongue at one end of each upright and the other end of the core being spaced axially inwardly of the other end of the panel members to provide a multi-sided socket at the other end of each upright dimensioned to non-rotatably receive the tongue on an axially aligned upright, at least some of said shelves having openings adjacent each corner thereof inwardly of the periphery of the shelf for receiving the tongues on the uprights, and said tongues having a length to extend through said openings in the shelves and into the socket in an axially aligned upright.

2. A shelving apparatus according to claim 1 wherein said shelves have a depending flange engageable with the outer faces of the uprights adjacent the corners of the shelves.

3. A shelving apparatus according to claim 1 wherein said openings in the shelves have a configuration complementary to said tongues in the uprights to non-rotatably receive the same.

4. A shelving apparatus according to claim 1 wherein said uprights have an L-shaped cross-sectional configuration.

5. In a free-standing shelving apparatus including a plurality of shelves disposed in vertically spaced relation and a plurality of uprights extending between each shelf and the next lower shelf, the improvement comprising each upright having a pair of lengthwise extending legs longitudinally interconnected to provide a generally L-shaped cross-section, each upright having a socket of L-shaped cross-section opening at one end thereof and a tongue of L-shaped cross-section extending from the other end thereof, each tongue having a cross-sectional thickness sufficiently less than that of the upright to be telescopically receivable in the socket in an endwise aligned upright and each tongue defining a shoulder at its juncture with the upright, at least one of said shelves having a plurality of L-shaped openings arranged in a pattern at spaced locations inwardly of the periphery thereof for receiving the tongues on the uprights.

6. In a free-standing shelving apparatus including an upper shelf, at least one intermediate shelf and a base shelf of polygonal configuration disposed in vertically spaced relation and a plurality of uprights extending between each shelf and the next lower shelf adjacent the corners of the shelves, the improvement comprising said intermediate and base shelves having a plurality of openings of L-shaped configuration arranged adjacent the corners of the shelves at locations inwardly of the periphery thereof and with the legs of the L-shaped openings extending generally parallel to the edges of the polygonal shelf, said uprights each having a pair of lengthwise extending legs longitudinally interconnected to provide a generally L-shaped cross-section, each upright having a socket of L-shaped cross-section opening at one end thereof and a tongue of L-shaped cross-section extending from the other end thereof, each tongue having leg portions of a cross-sectional thickness dimensioned less than that of the legs of the upright to extend through an L-shaped opening in the shelf and into the socket in an endwise aligned upright and each tongue defining a shoulder at its juncture with the upright for engaging a face on the shelf around the L-shaped opening therein.

7. A shelving apparatus according to claim 6 wherein each upright includes a first and second elongated solid flat core members adhesively joined together to form an elongated generally L-shaped core, and outer and inner panel members adhesively joined to each of the faces of the L-shaped core, one end of the L-shaped core being spaced outwardly in a direction lengthwise of the upright from one end of the panel members to provide said L-shaped tongue and the other end of the L-shaped core being spaced inwardly from the other end of the panel members to provide said L-shaped socket.

8. A shelving apparatus according to claim 6 wherein said intermediate shelf has a depending flange extending around the outer periphery thereof and spaced outwardly from the L-shaped openings therein a distance to engage both legs of the L-shaped uprights positioned between the intermediate shelf and the next lower shelf.

9. A shelving apparatus according to claim 6 wherein said base shelf has a depending base flange extending around the outer periphery thereof to space the base shelf above the floor, and means on said base flange engageable with both leg portions of the L-shaped tongues on the uprights when the latter are extended through the L-shaped openings in the base shelf to stabilize the shelving apparatus.

10. A shelving apparatus according to claim 9, said intermediate shelf having a depending flange extending around the outer periphery thereof and spaced outwardly from the L-shaped openings therein, a distance to engage both legs of the L-shaped uprights positioned between the intermediate shelf and the next lower shelf.

11. A shelving apparatus according to claim 10 wherein said upper shelf has a depending flange engageable with both legs of the L-shaped uprights positioned between the upper shelf and the next lower shelf.

12. A shelving apparatus according to claim 6 wherein each upright includes at least two endwise aligned sections each having an L-shaped socket in one end and an L-shaped tongue at the other end.

* * * * *